US010039393B1

(12) United States Patent
Beale

(10) Patent No.: US 10,039,393 B1
(45) Date of Patent: Aug. 7, 2018

(54) CALENDAR FRAME ASSEMBLY

(71) Applicant: Cynthia Beale, Cheapeake, VA (US)

(72) Inventor: Cynthia Beale, Cheapeake, VA (US)

( * ) Notice: Subject to any disclaimer, the term of this patent is extended or adjusted under 35 U.S.C. 154(b) by 0 days.

(21) Appl. No.: 15/597,245

(22) Filed: May 17, 2017

(51) Int. Cl.
*A47G 1/06* (2006.01)

(52) U.S. Cl.
CPC ..... *A47G 1/065* (2013.01)

(58) Field of Classification Search
CPC .. A47G 1/065; A47G 1/16; A47G 1/06; G09F 1/12; G09F 1/10
See application file for complete search history.

(56) References Cited

U.S. PATENT DOCUMENTS 337,033 A * 3/1886 Thonssen ..... A47G 1/0616 40/799
1,617,304 A * 2/1927 Groeschel ..... G03B 21/64 40/709
2,218,409 A 10/1940 Smalls
2,223,674 A * 12/1940 Cohen ..... A47G 1/0627 40/799
4,276,703 A 7/1981 Brindley
4,850,125 A * 7/1989 Green ..... A47G 1/0605 40/737
4,924,611 A * 5/1990 Shaw ..... G09F 7/08 40/200
5,638,096 A * 6/1997 Schwartz ..... G06F 1/1607 248/442.2
5,661,918 A 9/1997 Malcolm et al.
D385,708 S 11/1997 Key et al.
6,345,456 B1 2/2002 Bracken
6,478,282 B1 * 11/2002 Flemming ..... A47B 21/045 248/205.2
6,543,167 B1 * 4/2003 Dwyer ..... A47B 21/045 248/442.2
6,550,172 B2 * 4/2003 Korpai ..... G06F 1/1607 40/725
D486,831 S * 2/2004 Dayani ..... D14/448
D508,054 S * 8/2005 Ramsey ..... D14/448
D508,695 S * 8/2005 Vaughn ..... D14/448
D530,103 S * 10/2006 Phillips ..... D6/302
7,841,574 B1 * 11/2010 Harris ..... G06F 1/1611 248/444.1
8,770,416 B1 7/2014 Guida
2007/0084096 A1 4/2007 Davis et al.

FOREIGN PATENT DOCUMENTS

WO WO9800052 1/1998

* cited by examiner

*Primary Examiner* — Cassandra H Davis

(57) ABSTRACT

A calendar frame assembly includes a frame that may positioned on a support surface thereby facilitating the frame to surround a calendar. A plurality of pockets is provided and each of the pockets is coupled to the frame. Additionally, each of the pockets may insertably receive a photo. Each of the pockets is comprised of a translucent material such that the photo in each of the pockets is visible. A plurality of strips is provided and each of the strips is selectively written on. Each of the strips is removably positioned in the frame and each of the strips is visible through said frame.

9 Claims, 4 Drawing Sheets

CALENDAR FRAME ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to frame devices and more particularly pertains to a new frame device for selectively displaying photos in conjunction with a calendar.

BRIEF SUMMARY OF THE INVENTION

An embodiment of the disclosure meets the needs presented above by generally comprising a frame that may positioned on a support surface thereby facilitating the frame to surround a calendar. A plurality of pockets is provided and each of the pockets is coupled to the frame. Additionally, each of the pockets may insertably receive a photo. Each of the pockets is comprised of a translucent material such that the photo in each of the pockets is visible. A plurality of strips is provided and each of the strips is selectively written on. Each of the strips is removably positioned in the frame and each of the strips is visible through said frame.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
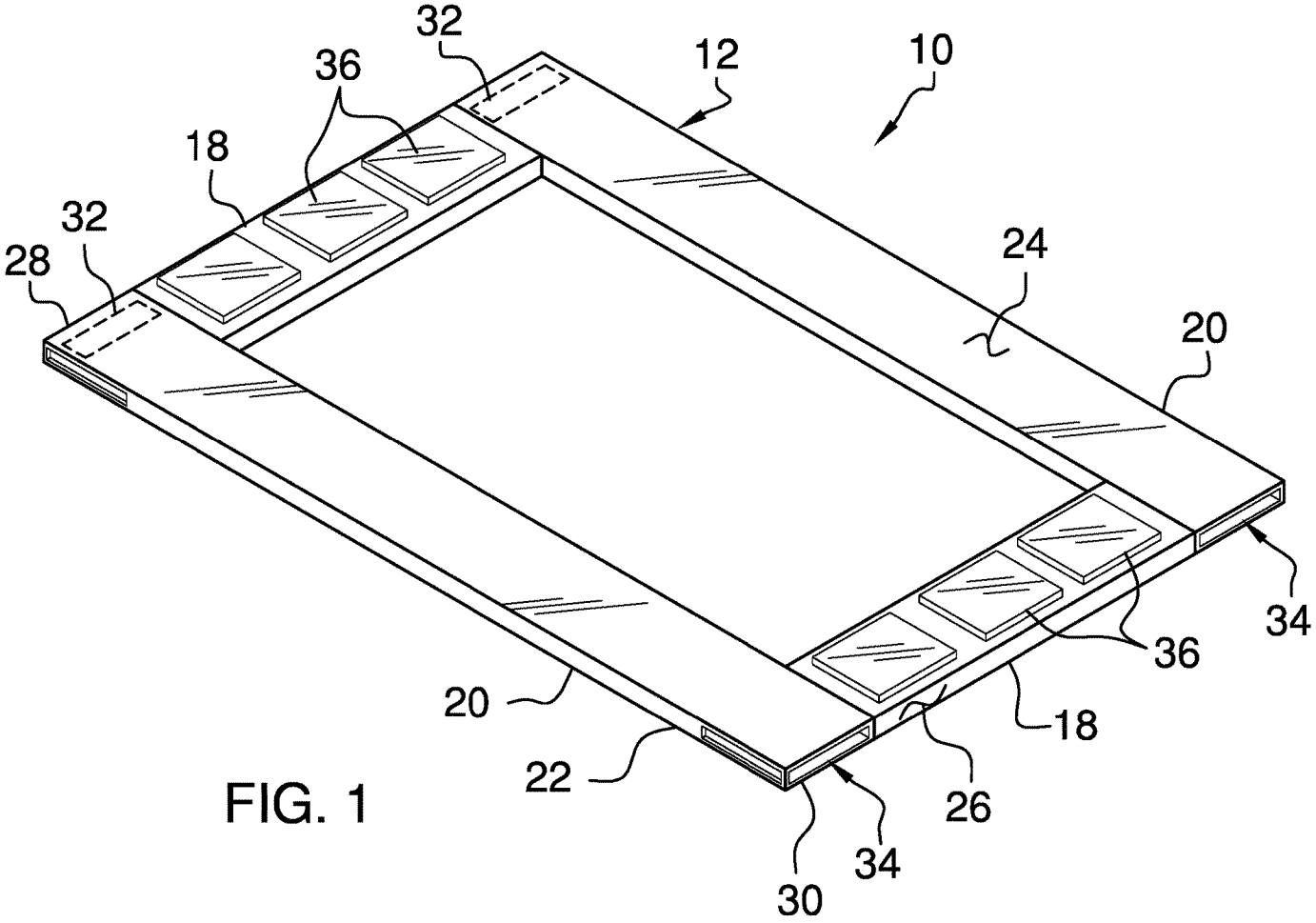
FIG. 1 is a top perspective view of a calendar frame assembly according to an embodiment of the disclosure.
Figure 2:
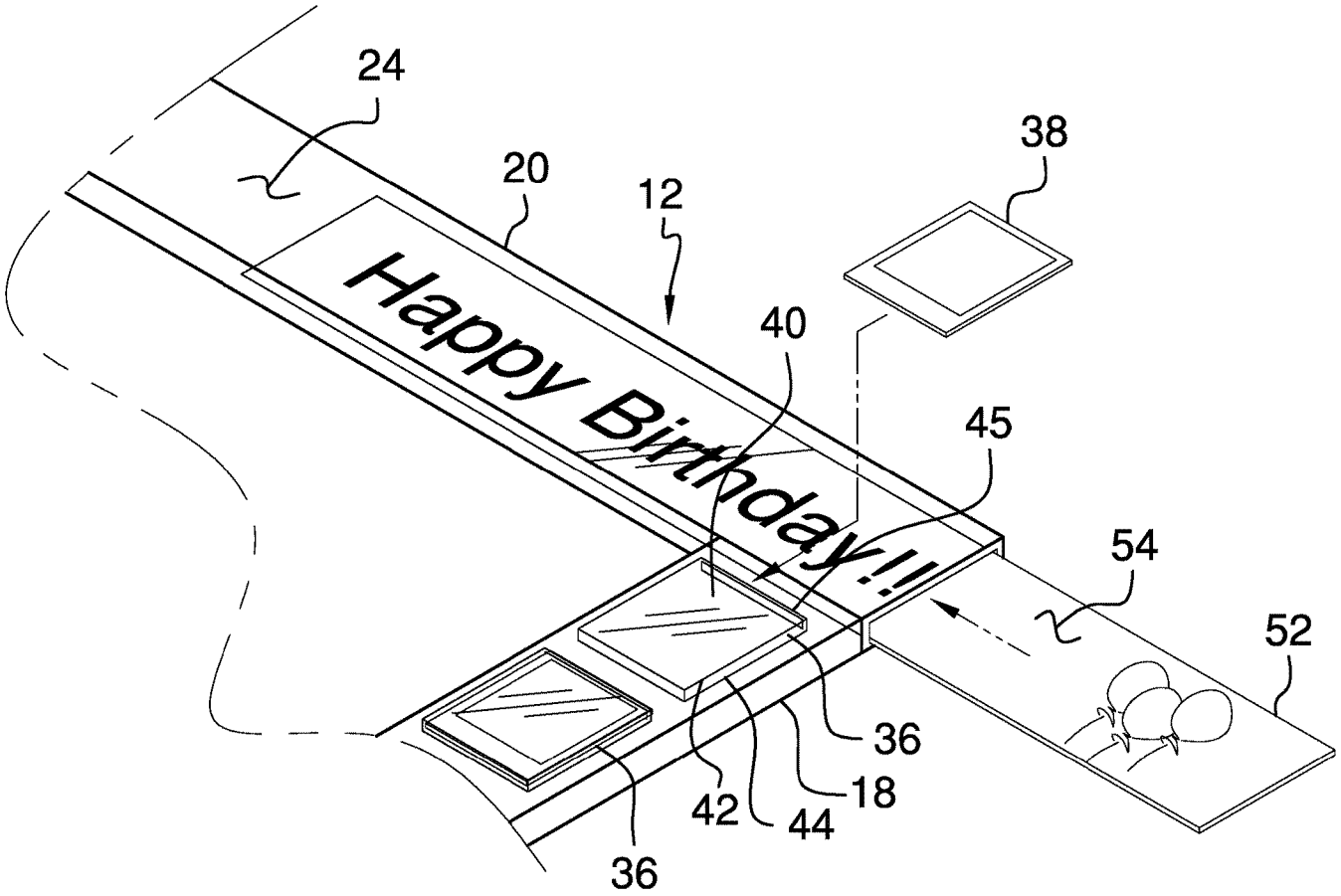
FIG. 2 is a perspective view of an embodiment of the disclosure.
Figure 3:
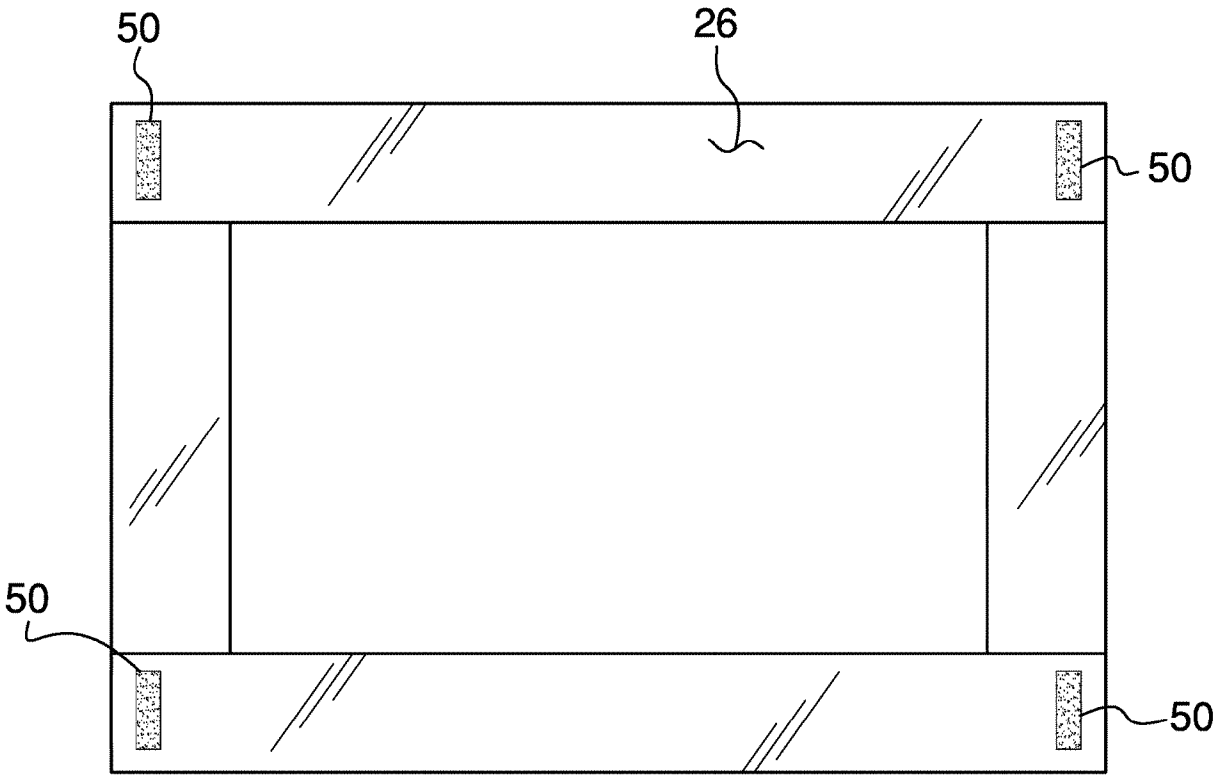
FIG. 3 is a bottom view of an embodiment of the disclosure.
Figure 4:
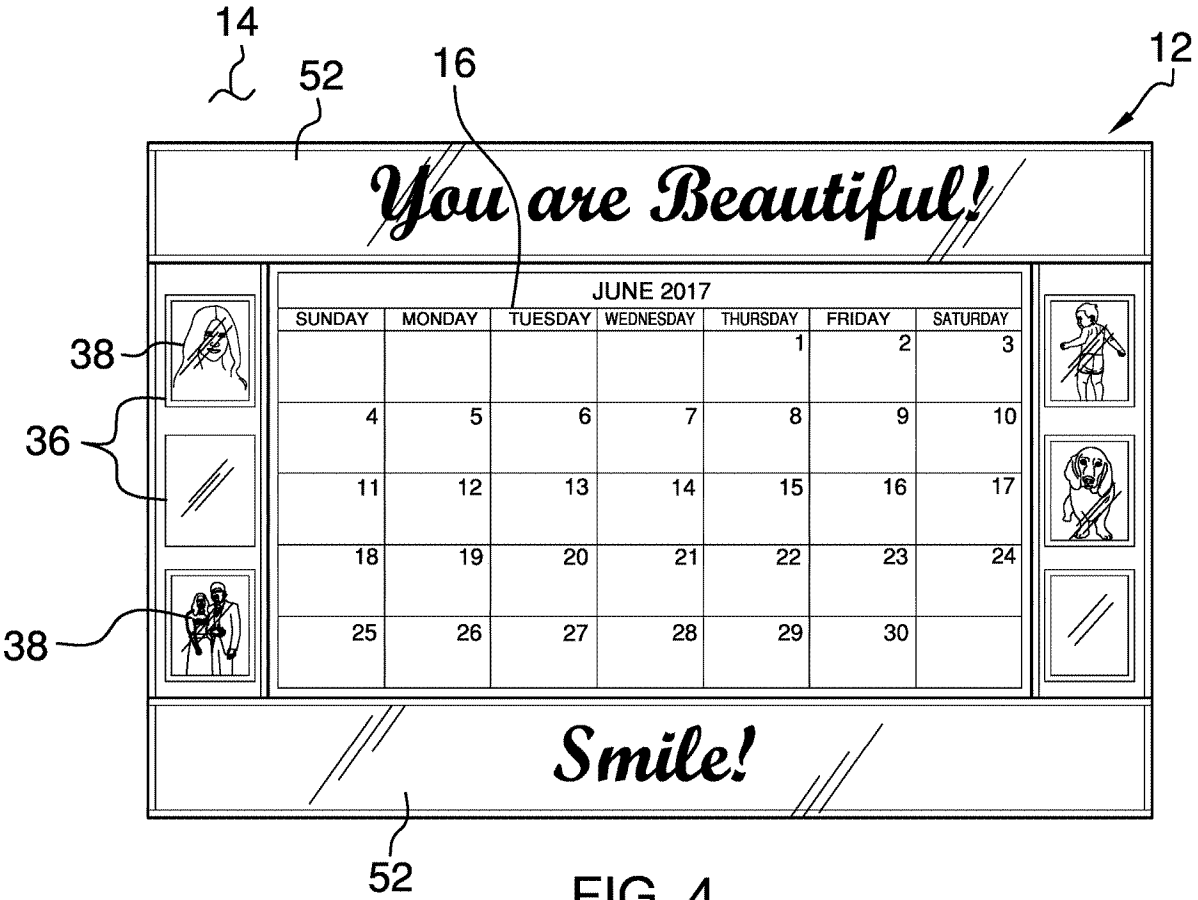
FIG. 4 is a perspective in-use view of an embodiment of the disclosure.

With reference now to the drawings, and in particular to FIGS. 1 through 4 thereof, a new frame device embodying the principles and concepts of an embodiment of the disclosure and generally designated by the reference numeral 10 will be described.

As best illustrated in FIGS. 1 through 4, the calendar frame assembly 10 generally comprises a frame 12 that is positioned on a support surface 14 thereby facilitating the frame 12 to surround a calendar 16. The support surface 14 may be a desk top, a table top or any other horizontal support surface 14. Additionally, the calendar 16 may be a desk calendar of any conventional design. The frame 12 has a pair of lateral members 18 extending between a pair of longitudinal members 20. The lateral members 18 are spaced apart from each other such that the frame 12 has a rectangular shape and each of the longitudinal members 20 is substantially hollow. Each of the longitudinal members 20 is comprised of a translucent material.

The frame 12 has a bottom surface 22, a top surface 24 and a peripheral surface 26 extending therebetween. The peripheral surface 26 corresponding to each of the longitudinal members 20 has a first side 28 and a second side 30. The bottom surface 22 is positioned on the support surface 14 such that the calendar 16 is visible between the lateral and longitudinal members 20. The first side 28 corresponding to each of the longitudinal members 20 has a first aperture 32 extending into an interior of the corresponding longitudinal member 20. Additionally, the second side 30 corresponding to each of the longitudinal members 20 has a second aperture 34 extending into the interior of the corresponding longitudinal member 20.

A plurality of pockets 36 is provided and each of the pockets 36 is coupled to the frame 12 to insertably receive a photo 38. Each of the pockets 36 is comprised of a translucent material such that the photo 38 in each of the pockets 36 is visible. Each of the pockets 36 is positioned on top surface 24 of the frame 12. Moreover, each of the pockets 36 has a first wall 40 and a perimeter wall 42 extending downwardly therefrom. The perimeter wall 42 corresponding to each of the pockets 36 has a distal edge 44 with respect to the first wall 40.

The distal edge 44 corresponding to each of the pockets 36 is coupled to the top surface 24 having the first wall 40 corresponding to each of the pockets 36 being spaced from the top surface 24. The perimeter wall 42 corresponding to each of the pockets 36 has an open side 45 to insertably receive the photo 38. The plurality of pockets 36 comprises a set of first pockets 46 and a set of second pockets 48. Each of the first 40 and second 42 pockets is positioned on a corresponding one of the lateral members 18.

A plurality of mating members 50 is provided and each of the mating members 50 is coupled to the frame 12 to engage the support surface 14. Thus, the frame 12 is inhibited from sliding on the support surface 14. Each of the mating members 50 is positioned on the bottom surface 22 of the frame 12. The mating members 50 are spaced apart from each other and are distributed around the frame 12. Additionally, each of the mating members 50 may comprise a hook and loop fastener or the like.

A plurality of strips 52 is provided and each of the strips 52 is selectively written on. Each of the strips 52 is removably positioned in the frame 12. Each of the strips 52 has a primary surface 54 and the primary surface 54 is written on. Moreover, each of the strips 52 is slidably inserted into a selected one of the first 32 and second 34 apertures on a corresponding one of the longitudinal members 20. In this way the writing on the strips 52 is visible through the corresponding longitudinal member 20. The writing may be any selected statement, a single word, an image or any other written indicia.

In use, the frame 12 is positioned on the support surface 14 such that the frame 12 surrounds the calendar 16. Moreover, the calendar 16 is visible between the lateral and longitudinal members 20. Each of the pockets 36 insertably receives a selected photo 38. In this way the selected photo 38 is displayed in conjunction with the calendar 16 without being attached to the calendar 16. Selected ones of the strips 52 are written on and the selected strip is inserted into a selected one of the longitudinal members 20. Thus, the writing on the selected strips 52 is visible through the frame 12. The frame 12 facilitates each of the photos 38 and the writing on the strips 52 to be displayed in conjunction with any calendar 16, at any time. In this way the photos 38 and the writing on the strips 52 may be displayed for consecutive months and years. Moreover, the photos 38 are removable and replaceable at any selected time irrespective of the calendar 16.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A calendar frame assembly being configured to selectively display photos, said assembly comprising:

a frame being configured to be positioned on a support surface thereby facilitating said frame to surround a calendar, the frame is comprised of a translucent material, said frame having a pair of lateral members extending between a pair of longitudinal members, said lateral members being spaced apart from each other such that said frame has a rectangular shape, each of said longitudinal members being substantially hollow, each of said longitudinal members being comprised of a translucent material, said frame having a bottom surface, a top surface and a peripheral surface extending therebetween, said peripheral surface corresponding to each of said longitudinal members having a first side and a second side, said bottom surface being configured to be positioned on the support surface having the calendar being visible between said lateral and longitudinal members;

a plurality of pockets, each of said pockets being coupled to an associated one of said lateral members of said frame on said top surface of said frame wherein each of said pockets is configured to insertably receive a photo positioned on said top surface of said frame, each of said pockets being comprised of a translucent material wherein the photo in each of said pockets is visible; and a plurality of strips, each of said strips being configured to be written on, each of said strips being removably positioned in an interior slot of said longitudinal members of said frame such that each of said strips is visible through said top surface of said frame.

2. The assembly according to claim 1, wherein said first side corresponding to each of said longitudinal members has a first aperture extending into said interior slot of said corresponding longitudinal member.

3. The assembly according to claim 1, wherein said second side corresponding to each of said longitudinal members has a second aperture extending into said interior slot of said corresponding longitudinal member.

4. The assembly according to claim 1, wherein each of said pockets is positioned on top surface of said frame, each of said pockets having a first wall and a perimeter wall extending downwardly therefrom, said perimeter wall corresponding to each of said pockets having a distal edge with respect to said first wall, said distal edge corresponding to each of said pockets being coupled to said top surface having said first wall corresponding to each of said pockets being spaced from said top surface.

5. The assembly according to claim 4, wherein said perimeter wall corresponding to each of said pockets has an open side wherein said open side is configured to insertably receive the photo.

6. The assembly according to claim 4, wherein said plurality of pockets comprises a set of first pockets and a set of second pockets, each of said first and second pockets being positioned on a corresponding one of said lateral members.

7. The assembly according to claim 1, further comprising a plurality of mating members, each of said mating members being coupled to said frame wherein each of said mating members is configured to engage the support surface, each of said mating members being positioned on said bottom surface of said frame, said mating members being spaced apart from each other and being distributed around said frame.

8. The assembly according to claim 1, further comprising:

a plurality of first apertures extending through said frame;

a plurality of second apertures extending through said frame; and each of said strips has a primary surface, said primary surface being configured to be written on, each of said strips being slidably inserted into a selected one of said first and second apertures on a corresponding one of said longitudinal members wherein the writing on said strips is visible through said corresponding longitudinal member.

9. A calendar frame assembly being configured to selectively display photos, said assembly comprising:

a frame being configured to be positioned on a support surface thereby facilitating said frame to surround a calendar, said frame having a pair of lateral members extending between a pair of longitudinal members, said lateral members being spaced apart from each other such that said frame has a rectangular shape, each of said longitudinal members being substantially hollow, each of said longitudinal members being comprised of a translucent material, said frame having a bottom surface, a top surface and a peripheral surface extending therebetween, said peripheral surface corresponding to each of said longitudinal members having a first side and a second side, said bottom surface being configured to be positioned on the support surface having the calendar being visible between said lateral and longitudinal members, said first side corresponding to each of said longitudinal members having a first aperture extending into an interior slot of said corresponding longitudinal member, said second side corresponding to each of said longitudinal members having a second aperture extending into said interior slot of said corresponding longitudinal member;

a plurality of pockets, each of said pockets being coupled to an associated one of said lateral members of said frame on said top surface of said frame wherein each of said pockets is configured to insertably receive a photo positioned on said top surface of said frame, each of said pockets being comprised of a translucent material wherein the photo in each of said pockets is visible, each of said pockets being positioned on top surface of said frame, each of said pockets having a first wall and a perimeter wall extending downwardly therefrom, said perimeter wall corresponding to each of said pockets having a distal edge with respect to said first wall, said distal edge corresponding to each of said pockets being coupled to said top surface having said first wall corresponding to each of said pockets being spaced from said top surface, said perimeter wall corresponding to each of said pockets having an open side wherein said open side is configured to insertably receive the photo, said plurality of pockets comprising a set of first pockets and a set of second pockets, each of said first and second pockets being positioned on a corresponding one of said lateral members;

a plurality of mating members, each of said mating members being coupled to said frame wherein each of said mating members is configured to engage the support surface, each of said mating members being positioned on said bottom surface of said frame, said mating members being spaced apart from each other and being distributed around said frame; and a plurality of strips, each of said strips being configured to be written on, each of said strips being removably positioned in an associated one of said longitudinal members of said frame such that each of said strips is visible through said top surface of said frame, each of said strips having a primary surface, said primary surface being configured to be written on, each of said strips being slidably inserted into a selected one of said first and second apertures on a corresponding one of said longitudinal members wherein the writing on said strips is visible through said corresponding longitudinal member.

* * * * *